US005754142A

United States Patent [19]

Wine

[11] Patent Number: 5,754,142

[45] Date of Patent: May 19, 1998

[54] HIGH EFFICIENCY ANTENNA USING PARALLEL CONDUCTORS, SINGLE CONDUCTOR AND SUPPORTING MATERIALS

[76] Inventor: Jerry Wine, 98-281 Ualo St. #T1, Aiea, Hi. 96701

[21] Appl. No.: 372,944

[22] Filed: Jan. 17, 1995

[51] Int. Cl.[6] ..... H01Q 11/12

[52] U.S. Cl. ..... 343/744; 343/741; 343/742; 343/748

[58] Field of Search ..... 343/741, 742, 343/743, 744, 747, 748, 866, 870

[56] References Cited

U.S. PATENT DOCUMENTS

| | | | |
|---|---|---|---|
| 2,682,608 | 3/1954 | Johnson | 343/802 |
| 3,209,358 | 9/1965 | Felsenheld | 343/745 |
| 3,508,274 | 4/1970 | Kesler et al. | 343/758 |
| 3,521,289 | 7/1970 | Mayes | 343/806 |
| 3,875,572 | 4/1975 | Kay | 343/803 |
| 3,958,248 | 5/1976 | Holshouser et al. | 343/803 |
| 4,423,423 | 12/1983 | Bush | 343/803 |
| 4,468,674 | 8/1984 | Blonder | 343/815 |
| 4,801,944 | 1/1989 | Madnick et al. | 343/742 |
| 4,847,491 | 7/1989 | Piole | 343/748 |
| 4,920,353 | 4/1990 | Mori et al. | 343/748 |
| 4,947,180 | 8/1990 | Schotz | 343/743 |
| 5,243,356 | 9/1993 | Hama | 343/744 |

*Primary Examiner*—Donald T. Hajec
*Assistant Examiner*—Tan Ho

[57] ABSTRACT

A versatile antenna system that, can help improve and produce a new line of TVS, radios, pagers, cordless, radio telephone and other communications gear. In its basics, the antenna is smaller in its wavelength, competitive in value. Some additional features described can make this antenna flexible and provide fast tuning, that can be more stable, with consideration to price, than an analog controlled device. The antenna can be utilized in a number of commercial applications and with the additional features described, it can have a number of advantages over the conventional telescoping antennas used for short wave, communications, TV or other uses.

4 Claims, 3 Drawing Sheets

Tunable Resonator Antenna Circuit System (TRACS)

Tunable Resonator Antenna Circuit System (TRACS)

HIGH EFFICIENCY ANTENNA USING PARALLEL CONDUCTORS, SINGLE CONDUCTOR AND SUPPORTING MATERIALS

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

BACKGROUND OF THE INVENTION

The invention relates to antennas used in communications, short wave and amateur radio, television, commercial and hobby applications. A radio antenna is an electromagnetic wave medium interfacing apparatus. Some antennas can be designed mainly for receiving, others for transmitting, many transmitting antennas can be used for receiving as well.

Today, the air waves are filled with many signals of the electromagnetic frequency spectrum. In the past, relatively broadband antennas were used to pick up signals and have the receiver's preselector filter out the undesired frequencies. With more usage and crowding of the radio spectrum it is more cost effective, in many instances, by having the antenna preresonate and assist the front end of the receiver. This design prevents front end overload and undesired frequencies that could cause spurious output in the receiver. The invention would motivate the design of more compatible systems with antennas coordinated to track and tune along with the system. In past designs, filtering is emphasized at the receiver's preselector, rather than at the antenna, more undesired frequencies would result, increasing the possibility of spurious output, that can be costly to remove, once in the system. This invention can be made to prevent a wide range of frequencies to enter the system. The new invention would have a cost incentive to prevent the undesired frequencies rather than post-system filtering. The tunability feature is just one of the many design advantages that can be evident by the accompanying information.

Many commercially available products use a singular telescopic antenna that, in a example such as in a portable TV set may require readjustment, since the frequencies of TV channels may vary as in several octaves or more. It should be possible with this invention to provide more convenient automatic tuning with each corresponding TV or Radio channel frequency, and could incorporate several units in a system to reduce ghosting or fading.

SUMMARY OF THE INVENTION

The invention comprises unique combinations of antenna design components with the refinements made to simplify and provide an antenna that is versatile even in the basic embodiment configuration.

An object of the current invention is to improve communications, that could help in times of rescue, and in emergencies, where locations a telephone is impractical whereas a wireless or cordless medium of communication more practical.

A further object of the invention is to improve the commercial products, where many commercial portable products use sharp protruding, telescopic antennas. Protruding, telescopic antennas can be potential dangerous to the eyes, especially when many of the products are meant for portable or mobile operation.

A further object of the invention is to provide a way to improve scientific instrumentation, especially in Radio Telescopes and other scientific data gathering instrumentation.

A further object of the invention is to improve commerically available gear. The versatile system can bring about more business development. Many antennas used today have been invented in the 1930's or earlier. Marconi invented his antenna just a little more than a hundred years ago to prove commercial feasibility. Television rabbit ear type antennas can be replaced with this invention as well as many communication antennas. Further objects of this invention can be made apparent by the accompanying drawings and description, and other ensuing information. This figure has been copyright protected.

REFERENCE NUMERALS IN DRAWINGS

FIG.1

Figure 1:
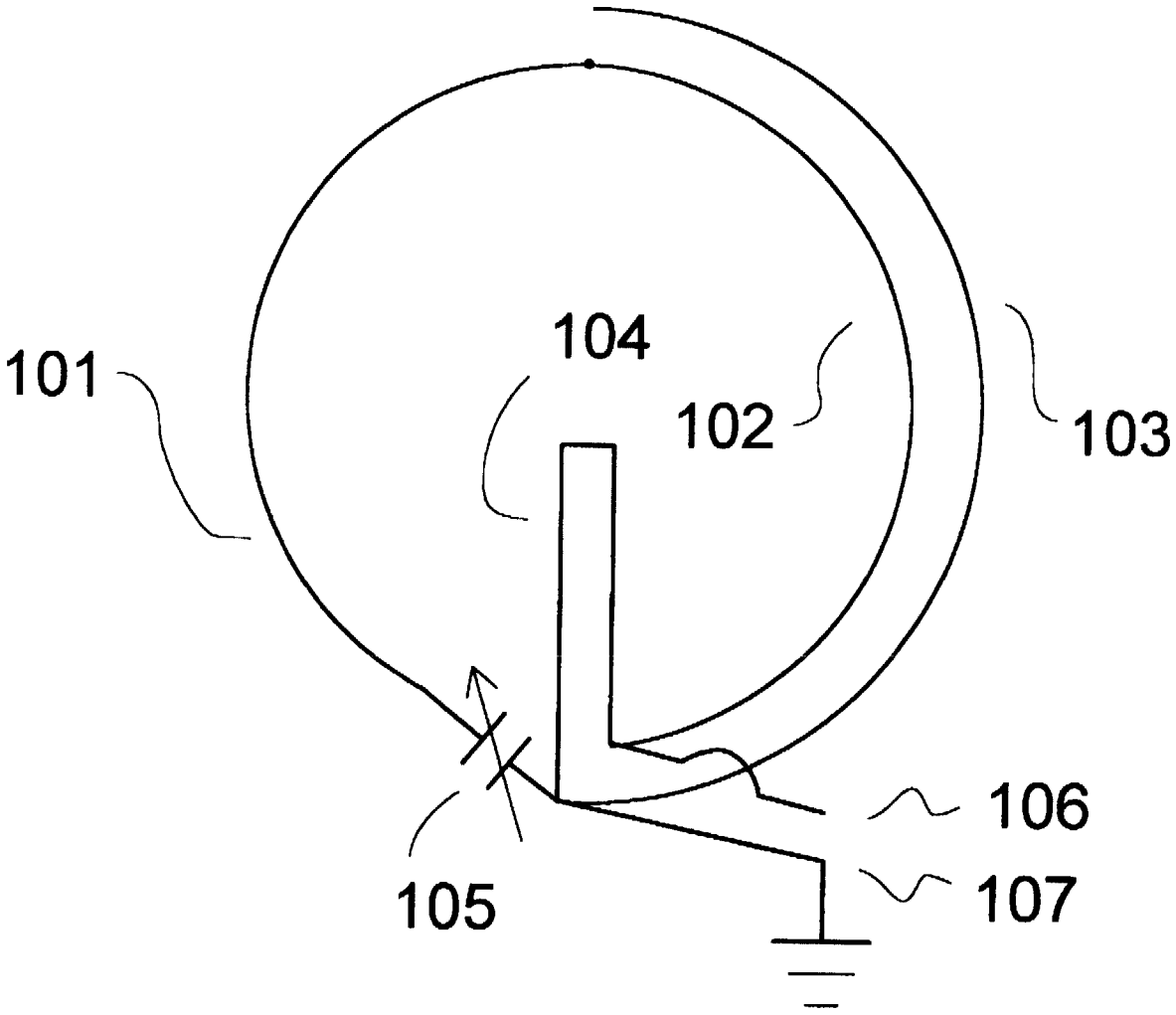
FIG. 1 shows the basic loop antenna, various shapes, configurations, translations thereof that can be made apparent by the accompanying drawings, description, claims and other ensuing information.

101 Conductive Loop segment
102 Conductive loop portion
103 Conductive open adjacent portion
104 Load Circuit, shorted stub
105 Resonator Circuit, Variable Capacitive tuning circuit
106 Signal Port, first antenna terminal
107 Signal Port, second antenna terminal

FIG. 2

Tunable Resonance Antenna Circuit System (TRACS)

FIG. 3

301 Loop lower housing, can be telescopic, adjustable
302 Loop upper housing, can be telescopic, adjustable
303, 304 Fold swivel, angle or fold adjustable

DETAILED DESCRIPTION OF THE SHOWN EMBODIMENTS

The basic loop schematic is shown in FIG. 1. Though the shape in the schematic is circular, the schematic is primarily shown to provide the map of the electrical interconnection, rather than a specific arrangement. The conductive loop segment 101 and conductive loop portion 102 can be of the same material, the addition being the conductive loop length, being electrically continuous. The conductive meaning the material is capable of electrical conductivity at the appropriate frequency or frequencies loop segment 101, conductive loop portion 102, conductive adjacent open portion 103 could be of flexible, rigid or higher conductivity material. The adjacent portions of 102 and 103 could be of ribbon, cable or other means. The Signal Port first terminal, 106, is connected to the conductive loop portion 102, and to one side of Load Circuit, 104. The conductive open adjacent portion 103, is connected to the Signal Port second terminal, 107, and has a direct current open end, unconnected at the side closer to the conductive loop segment 101. The conductive adjacent open portion 103, is substantially geometrically parallel with the conductive loop portion 102. Labeled 102 and 103, both conductive portions are adjacent, such as being electrically insulated with a spacing, and can be accomplished using a dielectric material, with the electrical connections that could be various combinations of placement and materials of both conductors, such as being side by side, inside/outside, or evert, with FIG. I being the simplified schematic. Some examples of adjacent, or geometrically parallel conductors are by using tubular, (concentrically) parallel conductors, ribbon pairs, or other various means. The relationship between the total conductive loop (addition of lengths of conductive loop segment 101 plus conductive loop portion 102), is generally that the conductive portion 102 or 103 is around half or less than the length of the total the total loop length. The Resonator Return Circuit 105, in the basic form is a capacitor, or other resonating means with the main usage is to tune at the desired frequency or frequency ranges. This can be accomplished by many different methods that could be set, switched, trimmed or varied to make and provide accurate tuning as well as efficient signal transfer. The Load Circuit 104 is defined as a shorted stub, with its definition to comprise of: hairpin transformers, inductive reactance, an inductor that is shorter in length or smaller in inductance than what would normally be used if used as an radio frequency choke along a transmission line, essentially a conductive length that is from the Signal port first terminal to the second terminal, or basically a length of wire pair that is shorted at one end. It is hereon defined in this document as a shorted stub. These devices could be used along with combination of conventional devices. The main purpose is to allow or transform the impedance that is compatible with the system. The shorted stub can be used with other devices or other means to maximize the signal, its primary purpose is to transform the loop impedance to a level that could provide a proper load and signal transfer to the Signal Port, with two junctions (or terminals), antenna connection junction 106, and opposing connection junction 107. The Load Circuit 104 may affect tuning, though normally in a lesser extent than the Resonator Return Circuit 105. Though many possible impedance spacings could be used, if constructed of a standard 300 ohms impedance spacing for the conductive portion(s) 102, 103, and shorted stub for 104, the relationship of the shorted stub length was roughly within 5 to 25 percent of that of the total loop length (combination of loop segment 101 and adjacent portion 102, with individual lengths, 101,102,103 approximately equal). Lengths could be varied by standard means or more complex reactance circuit may help optimize at the desired frequency or frequencies. Standard practices in antenna feedline isolating, coupling at, near, or between the Signal Port first terminal, 106, and its second terminal, 107, can be utilized. Grounding, if necessary of the second terminal, 107, is possible. Though in the schematic the "ground" symbol at the, second terminal, 107 is shown, a ground may not be required connector that is normally the side of ground. Conventional means as used in antennas and various combinations of what is described in the accompanying information could be used, to improve antenna pattern or response. Combinations of conventional transformer, feedline isolation methods may be used.

The Resonator Circuit, comprised basically of capacitive reactance or resonance tuning circuit. This circuit is connected across the "hot" end of the conductive loop segment 101, and the second terminal Signal Port connection, 107. A basic circuit is normally a form of electronic capacitor. The primary circuit function is to tune or resonate the antenna to a particular frequency or frequencies.

The Load circuit 104, a shorted stub, as previously defined, is connected across or between the Signal Port, antenna first terminal 106, and second terminal 107. The primary circuit function is to transform or convert basic loop impedance to a reasonable load source impedance or to provide optimum transfer of signal with minimization of reflection or loss. The circuit has a secondary affect on the tuning. To cover a larger set of frequencies, the circuit could be made switchable. Standard antenna practices such as feedline isolating or a combination of antenna devices could be used.

A resonator tuning circuit is used to tune to the desired frequency resonance, it can be made into various shapes and sizes. Various methods in electronic circuit manufacture can be made to improve cost efficiency. Antenna resonators may differ from regular commercial variable capacitors in that it is meant to be part of the radiating antenna. A regular variable capacitor is not suggested for this type antenna, it may have the normally grounded rotor or cage shielding the plate(s), reducing signal effectiveness, since the plate(s) could have been part of the antenna.

The Tunable Resonance Antenna Circuit System (TRAC System), hereon called TRACS or the TRAC system, is a resonance producing circuit that allows logical direct digital interfacing that incorporates an effective antenna resonator. The name combines essentially the use of a logical set of reactance values with an effective antenna resonator that maximizes antenna efficiency compared to devices not primarily made for antenna usage, and could encompass parts or all of the antenna portion. The direct digital interfacing reduces the need for an additional analog to digital converter. It's resolution is determined by the antenna's minimum bandwidth and can be constructed in a binary format, with the resonator made to maximize antenna efficiency. It can facilitate tuning the antenna resonant frequencies easier and can give a compatible standards via computer or manual control. The specific sizes or dimensions, provide an example, however it exemplifies that many different combinations and sizes, frequencies, scaling of antenna could be made.

The merits using the TRAC system are, for a particular antenna price consideration, the design should be competitive to analog methods especially when the frequency information is fed directly from the system. With such or similar methods, it should be less noisy than analog voltage frequency control methods. Direct digital interfacing removes one extra step from having another electronic circuitry stage, that could cause additional delay for the control signal to travel, in essence it should be of less delay in response and possibly more stable since it does not need a digital to analog (D to A) converter. In essence the antenna with the TRAC system is in a sense the direct digital converter module. Electronic devices without use of the TRAC system may cause more ripple or transients in the control voltages. The reference voltage for the analog (D to A) converter in analog control would need to be precise. Thus the TRAC system method should be more repeatable than analog methods where voltages may drift, or susceptible to noise. A resonator set direct digital interfacing does not require the standard analog (D to A) converter and can be set to resonate an antenna at certain frequency with accuracy that is related to the quality of the logical units, determining the resolution and the bandwidth tolerance. With proper design of the switching method, the design should be more immune to noise in the control voltage than analog control methods.

Figure 2:
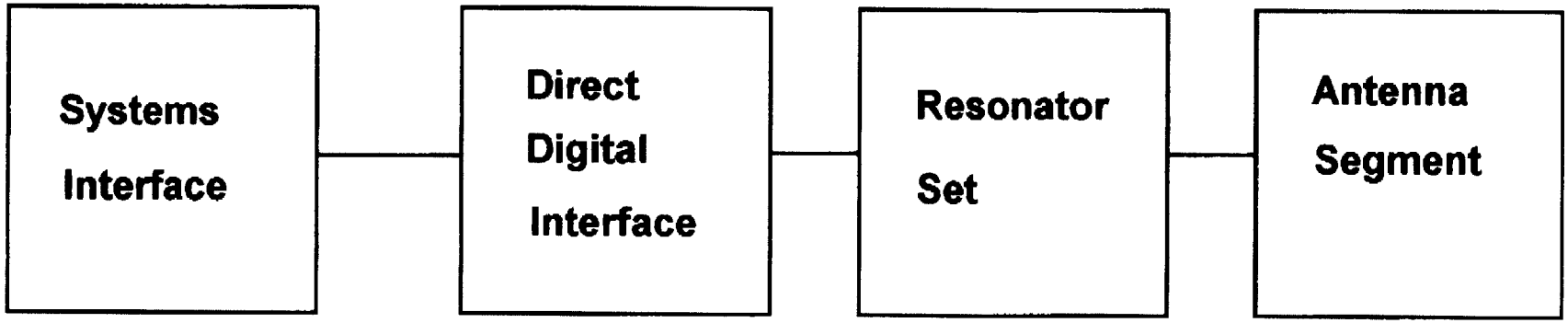
FIG. 2 is the system diagram of the Tunable Resonant Antenna Circuit System.

FIG. 2 is a basic block diagram of TRACS or TRAC system. The System Interface is how tuning information is input to the Antenna, the Direct Digital Interface and Resonator Set resonates the Antenna. FIG. 2 is more a system overview than specific and complete circuit designs.

Though many different combination of dimensions and shapes are possible, for experimental purposes a circular loop was constructed with the approximate dimensions of Conductive loop segment of 28 inches, the Conductive loop, adjacent Portion using 300 ohm line of 28 inches, Load Circuit (shorted stub) of 6 inches, or appropriate metric units. A graph is not shown, due to the fact of variations in construction and equipment. The relationship can be experimentally graphed by using a variable capacitor with a range of 5 to 50 pf in most cases should tune to 21 and 28 Megacycles and appropriate equipment. Various directional antenna systems can be constructed with this TRAC system antenna.

Figure 3:
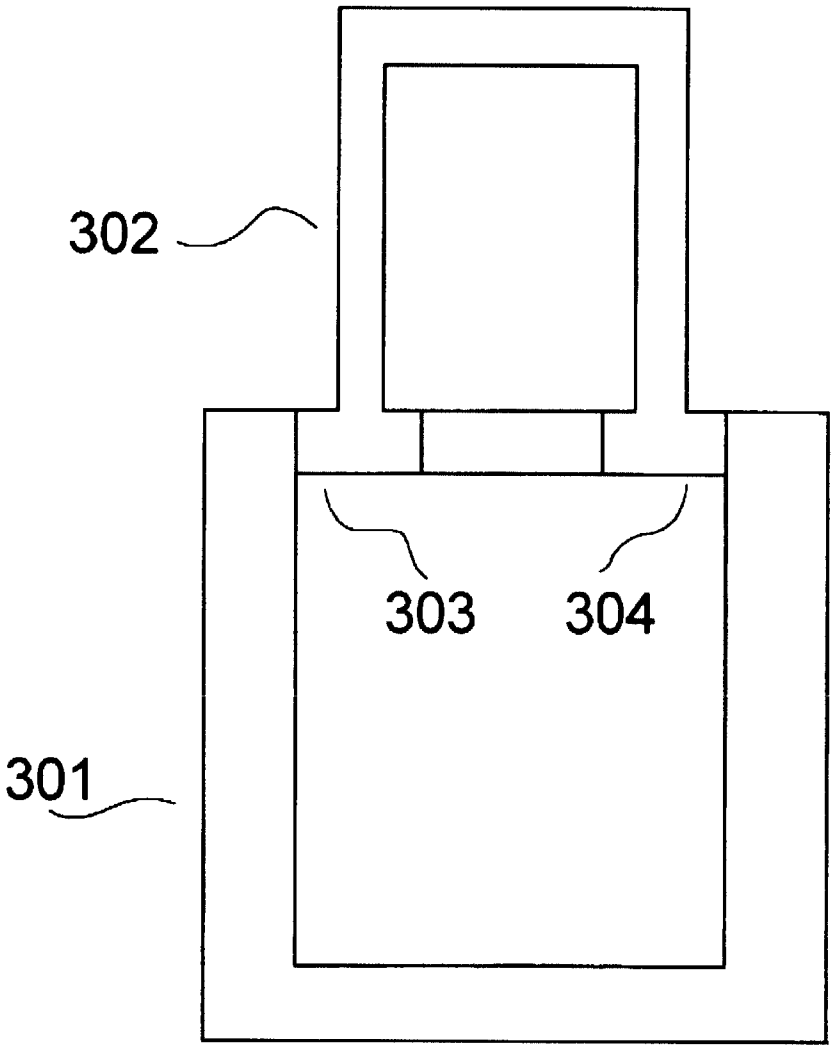
FIG. 3 is a drawing the antenna in a foldable, transportable antenna system.

FIG. 3 shows a method of housing the loop that can be more compact, transportable and versatile where 302 is the top part of the loop housing, using swivels 303, 304, folds to inside the 301 outer perimeter housing, that can be more durable and smaller during transporting or shipping, other methods can be evident by more close review. The added feature is that the loop can be usable even when partially folded in different angles, polarization. The unit can be more safely made with expandable side lengths than standard protruding telescopic antennas. Many different shapes, sizes can also be configured. The invention can give considerable reduction in shipping size.

With the various configurations of the invention, the antenna be built in the handle of short wave receivers, portable TV sets, reducing the amount of sharp protruding antennas typical of portable equipment. There may be a new market for use with burglar alarm systems, two way pagers, radio-telephones in rural or emergency roadside settings and other new commercial markets, such as with use of new TV's and scanners, units designed with the antenna as part of the system, with standardized control and signal line(s) for tuning the antenna, especially useful in congested cities with high intermodulation problems.

What is claimed is:

1. An antenna comprising:

a signal port having a first terminal and a second terminal;

a conductive loop element having a first end and a second end, the first end electrically connected to the first terminal and the second end electrically connected to the second terminal through a resonance producing circuit;

a conductive portion being substantially parallel to the conductive loop element and having a first end connected to the second terminal and a second end not directly connected to the conductive loop element, and a shorted stub electrically connected between the first and second terminals.

2. The antenna as defined in claim 1 wherein the resonance producing circuit comprises at least a variable capacitive tuning circuit.

3. The antenna as defined in claim 1 wherein said antenna is foldable and adjustable.

4. The antenna as defined in claim 1 wherein said antenna is used in a directional system.

* * * * *